United States Patent [19]

Dechirot

[11] Patent Number: 4,660,723

[45] Date of Patent: Apr. 28, 1987

[54] DEVICE FOR HANGING AND SPACING PACKAGES WHICH ARE PRESENTED ON PEGS, AND PACKAGING BOX EQUIPPED WITH THIS DEVICE

[75] Inventor: Jean-Pierre Dechirot, Balan, France

[73] Assignee: Societe Vynex SA, France

[21] Appl. No.: 871,401

[22] PCT Filed: Sep. 9, 1985

[86] PCT No.: PCT/FR85/00242

§ 371 Date: May 6, 1986

§ 102(e) Date: May 6, 1986

[87] PCT Pub. No.: WO86/01785

PCT Pub. Date: Mar. 27, 1986

[30] Foreign Application Priority Data

Sep. 12, 1984 [FR] France ..... 84 14015

[51] Int. Cl.[4] ..... B65D 81/02

[52] U.S. Cl. ..... 206/493; 206/806; 206/497

[58] Field of Search ..... 206/806, 493, 497

[56] References Cited

U.S. PATENT DOCUMENTS

| | | | |
|---|---|---|---|
| 3,082,902 | 3/1963 | Kimbrough, Jr. | 206/806 |
| 4,020,947 | 5/1977 | Roccaforte | 206/806 |
| 4,166,532 | 9/1979 | Tsuchida et al. | 206/806 |
| 4,360,106 | 11/1982 | Irving et al. | 206/806 |
| 4,378,068 | 3/1983 | Bell | 206/806 |

FOREIGN PATENT DOCUMENTS

| | | | |
|---|---|---|---|
| 1480373 | 5/1967 | France | 206/806 |

*Primary Examiner*—Joseph Man-Fu Moy

*Attorney, Agent, or Firm*—Lerner, David, Littenberg, Krumholz & Mentlik

[57] ABSTRACT

The device is composed of a perforated tab (1), provided with a spacing flange (2) transmitting the push force at the level of the peg (3). The packaging box is composed of a semi-rigid box-shaped case (4), provided with edge areas on which a heat-sealable plastic film (5) is fixed, this film (5) also being utilized for hot adhesive-bonding the perforated tab (1) to the upper edge area (4*a*) of the box-shaped case (4).

8 Claims, 1 Drawing Figure

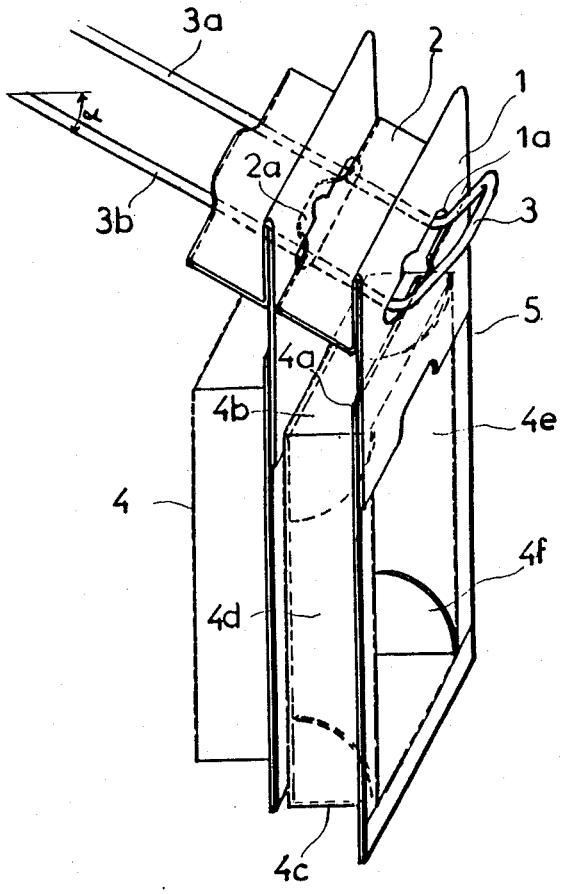
3a
2
1
1a
2a
3b
3
5
4a
4b
4e
4
4f
4d
4c

DEVICE FOR HANGING AND SPACING PACKAGES WHICH ARE PRESENTED ON PEGS, AND PACKAGING BOX EQUIPPED WITH THIS DEVICE

The invention relates to a device for hanging and spacing packages which are presented on pegs, and to a packaging box equipped with this device.

In order to hang packages, it is known to utilize perforated tabs which are sewn or adhesive-bonded to the upper portions of transparent bags containing products, or which are molded with the bag, or it is known to extend the product presentation cards upwards in instances where the products are covered with a film which is thermoformed and hot adhesive-bonded, or to have the cardboard cover adhesive-bonded to the edge of a box-shaped molded plastic case containing the products.

This method of hanging gives perfect results when the abovementioned packages are presented on horizontal pegs, but the situation is different when the pegs are inclined in order to bring about the continuous return of the packages towards the tip of the peg: by gravity when the pegs are inclined downwards, or under the action of a spring when the pegs are horizontal or inclined upwards: the object being to obtain a continuous sales front, which makes it easier both to seek particular products, and to grasp them.

In reality, the shape of these packages does not lend itself well to a good distribution of the push force which induces the return movement, and the result is that an unbalanced condition prevails, which manifests itself thru the packages leaving the pegs in an untimely manner when the push force is too high, which necessitates the voluntary limitation of the peg length, or voluntary abstention from loading the pegs fully.

As regards the packaging boxes which are currently in existence, the design of which has been mentioned above, these necessitate the use of special and rather expensive molds in order to produce the box-shaped case by thermoforming; a disadvantage which adds to the one already indicated above.

Package-hanging and spacing devices corresponding to the preamble of claim 1 have already been disclosed, namely those described in U.S. Pat. Nos. 3,254,761 and 4,291,807, the former describing the hanging of a package via a triangular-section tab obtained by expansion, the width of its upper portion, forming the base of the triangle, equalling the package thickness, while the latter describes a package-hanging tab which is back-folded over a portion of its width.

These devices were designed with a view to achieving a definite spacing of packages presented on horizontal pegs, and they would therefore require special configuration in order to be presented on inclined pegs.

The object of the invention is to remedy this disadvantage. This invention, as characterized in the claims, solves the problem implicit in achieving regular spacing of packages which, when presented on pegs, are continuously returned towards the tip of the peg, either by gravity or by means of a spring.

This device is composed of a perforated tab which is provided with a spacing flange, set in place at the level of the upper edge of the aperture thru which the peg passes, the peg itself forming part of the sales display facility. The packaging box is composed of a box-shaped cardboard case, provided with edge areas on which a heat-sealable plastic film is fixed, this film also being utilized for attaching the perforated tab to the upper edge area of the box-shaped cardboard case.

The length of the spacing flange exceeds the depth of the box-shaped case, divided by the cosine of the inclination angle of the pegs fitted to the sales display facility. This flange is extended by a small tab, its width corresponding to the limb-spacing of the type of twin-limb peg fitted to the sales display facilities, but being amenable to modification to suit other types.

In a preferred embodiment, the perforated tab and the spacing flange are made in a single piece, by folding and gluing.

The box-shaped cardboard case is produced by cutting, folding, and glueing.

The folding both of the spacing flange and of the box-shaped case is facilitated by pre-perforation along appropriate lines.

The upper and lower sides of the box-shaped case are joined to the other sides by means of glued tabs.

The perforated tab and the spacing flange are utilized as information-carrying areas, as are the back and sides.

The width of the box-shaped case, perforated tab and spacing flange can be multiplied by the number of pegs necessary for presenting a larger quantity of products, or for presenting very long products, while the aperture thru which the peg passes and the small tab extending the spacing flange can be repeated in an analogous manner.

The invention provides advantages which, in essence, amount to the fact that the packages are subjected to a push force which is located on the peg axis, at the level of the hanging tab, which eliminates any risk of the packages tilting and, in consequence, eliminates any risk of the leading packages coming off the peg, and of their being crushed under the pressure as they are returned forwards, either by gravity or by means of a spring, and to the fact that the molded plastic parts have been superceded by a box-shaped case which is produced from a semi-rigid material by cutting and folding, one such material being cardboard, and which is closed-off by means of a flexible transparent film, attached by hot adhesive-bonding.

The invention is explained in greater detail below, with the help of a drawing which represents a perspective view of packaging boxes which are arranged, in contact with each other, on a twin-limb peg which forms part of a sales display facility, this drawing representing only one embodiment.

The FIGURE prepared from the drawing shows box-shaped cases, 4, which are hung, by means of a tab 1, on the twin-limb peg 3, this peg 3 being inclined downwards, at an angle $\alpha$, the tab 1 being provided with an aperture 1*a*, and being attached to the upper edge area 4*a* of the box-shaped case 4 by means of the heat-sealable plastic film, 5, which is utilized to close-off the open front of the box-shaped case, and which is fixed to the edge areas of the said case by hot adhesive-bonding. The spacing is thus achieved by means of a flange 2, set in place at the level of the upper edge of the aperture 1*a*, thru which the peg passes, this flange 2 possessing a length which exceeds the depth of the box-shaped case, divided by the cosine of the inclination angle of the pegs, and being extended by a small tab, 2*a*, which fits into the space between the limbs 3*a* and 3*b* of the twin-limb peg 3 after having passed thru the aperture in the package situated just behind, namely the aperture thru which the peg passes. The push force from the package situated behind is thus retransmitted, by the spacing flange 2, to the package situated in front, at the level of the peg.

It will also be noticed, on the box-shaped case 4, that the upper and lower sides, 4*b* and 4*c* respectively, are joined to the vertical sides, 4*d* and 4*e*, by means of glued tabs 4*f*.

What is claimed is:

1. A device for suspending and spacing packages upon pegs comprising a box-shaped case, tab means extending from said box-shaped case, said tab means including an aperture for said peg upon which said package can be suspended, a spacing flange extending from said tab means at a location above said aperture, and heat-sealable plastic film means defining the edge areas of said box-shaped case and attaching said tab means to said box-shaped case.

2. The device of claim 1 wherein said spacing flange has a predetermined length, and wherein said pegs are intended to be fitted to a sales display unit and extend therefrom at a predetermined angle of inclination, and wherein said box-shaped case has a predetermined depth, said predetermined depth of said box-shaped case divided by the cosine of said angle of inclination substantially corresponding to the length of said spacing flange.

3. The device of claim 1 wherein said peg means has a predetermined width substantially corresponding to the width of said aperture in said tab means, and wherein said spacing flange includes a tabular extension adapted to enter the aperture in a adjacent package placed upon said peg means.

4. The device of claim 1 wherein said tab means and said spacing flange are formed as a unitary construction.

5. The device of claim 1 wherein sid box-shaped case is prepared from a single sheet of material, cut, folded and glued to a predetermined configuration.

6. The device of claim 5 wherein said box-shaped case is produced frpm a single sheet of material including predetermined perforation lines thereon.

7. The device of claim 6 wherein said single sheet of material includes tab means, whereby when said box-shaped case is folded said tab means facilitate gluing of said sides of said box-shaped case together.

8. The device of claim 1 wherein said tab means and said spacing flange comprise information carrying areas, and wherein said box-shaped case comprises information carrying areas.

* * * * *